United States Patent [19]

Price

[11] 4,249,269

[45] Feb. 10, 1981

[54] CAP VISOR

[75] Inventor: James E. Price, New Albany, Ind.

[73] Assignee: Adver-Togs, Inc., New Albany, Ind.

[21] Appl. No.: 823,208

[22] Filed: Dec. 5, 1977

[51] Int. Cl.[3] ..... A42B 1/02; A42B 1/04

[52] U.S. Cl. ..... 2/195; 2/192; 156/223

[58] Field of Search ..... 2/195, 191, 192, 200, 2/177, 178, 15, 12, 425, 68; 36/7.3; 428/189–194, 80, 514; 223/52; 156/223, 290

[56] References Cited

U.S. PATENT DOCUMENTS

| | | | |
|---|---|---|---|
| 2,716,753 | 9/1955 | Gordon | 2/195 |
| 2,875,447 | 3/1959 | Goldmerstein | 2/195 X |
| 3,039,113 | 6/1962 | Lipschutz | 2/195 |
| 3,072,915 | 1/1963 | Henschel | 2/195 |
| 3,128,474 | 4/1964 | Feldman | 2/195 |

OTHER PUBLICATIONS

Advertisement, Life, 11/15/1937, p. 58.

*Primary Examiner*—Werner H. Schroeder
*Assistant Examiner*—Andrew M. Falik
*Attorney, Agent, or Firm*—Warren D. Flackbert

[57] ABSTRACT

A cap visor defined by upper and lower layers of material having an insert board therebetween in a water sealed relationship. The upper layer of material includes a pattern of molded simulated stitch lines thereon.

2 Claims, 2 Drawing Figures

CAP VISOR

As is known, the popularity of a sport type cap, i.e. a cap with a visor, is quite widespread, as, for example, with golfers, fishermen, ballplayers or the like. One objection to the presently available sport type cap is that such is susceptible to being totally ruined if water flows on the visor, i.e. through the stitching, for example. Such water damage can result either by rain or the accidental dropping of the cap into a body of water. In any event, as each visor contains an insert board, the water causes the board to buckle, meaning that the cap loses its utility and also becomes rather unsightly on the wearer.

The invention overcomes the preceding objection by affording a visor in which the insert board is sealed within outer vinyl plastic coverings to define an envelope which is impervious to water. In order to provide the usual stitched appearance, the assembled envelope is placed within a mold for simulated stitch lines, and molding is then accomplished through a flow mold operation, the latter functioning by reason of high frequency radio waves.

Following the preceding steps, the remainder of the sports cap is assembled in a conventional manner. The finished product may be in various colors and vary style-wise to suit a particular end purpose. In any event, the cap visor of the invention presents a durable finished item and one which lends itself to a high production rate in that the usual visor stitching is eliminated.

Figure 1:
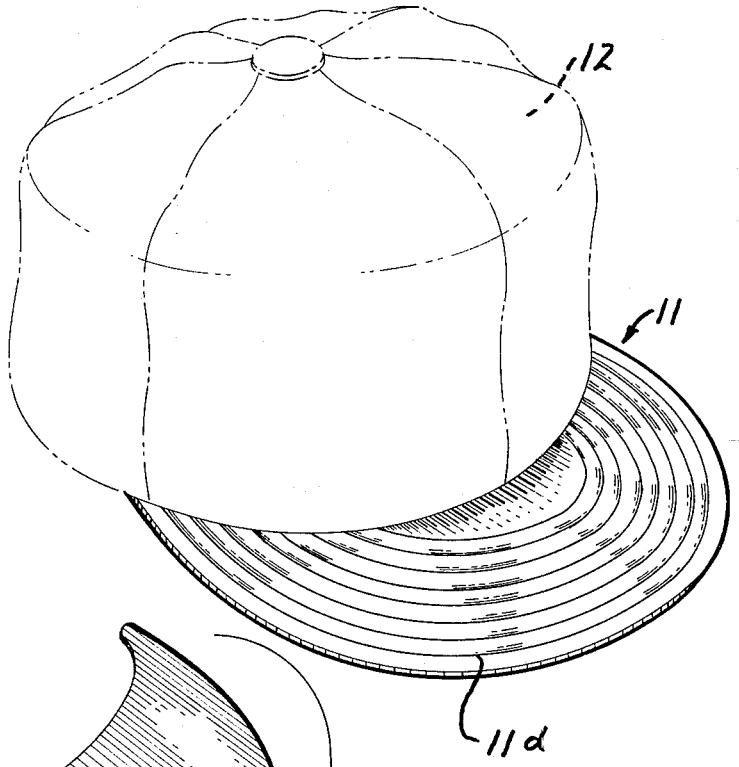
Figure 2:
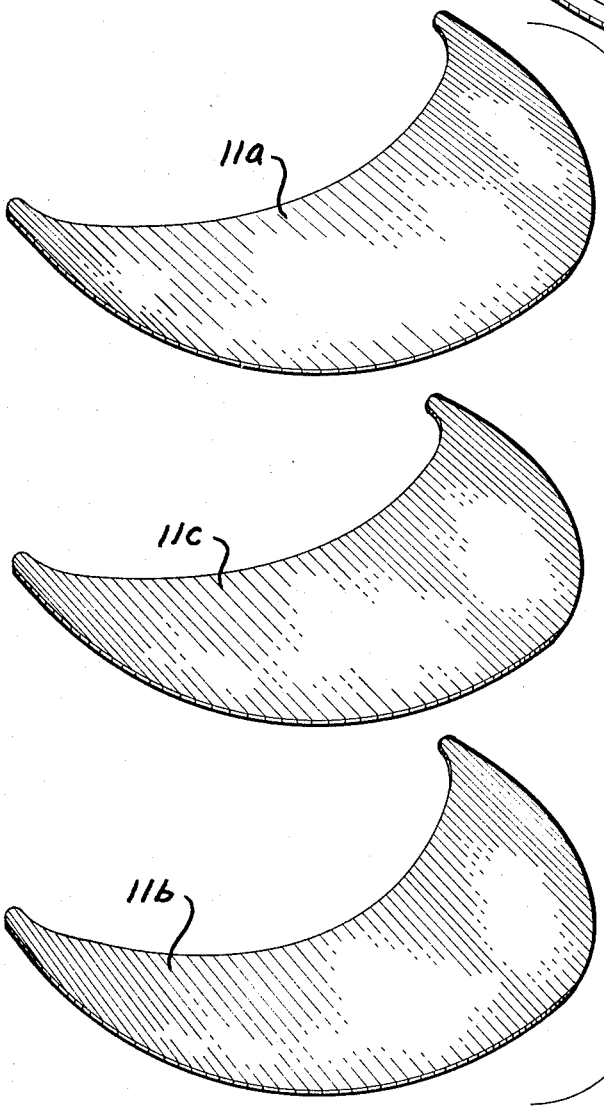

A better understanding of the present invention will become more apparent from the following description, taken in conjunction with the accompanying drawing, wherein FIG. 1 is a perspective view showing a finished cap visor in accordance with the teachings of the present invention, where the cap on which the visor is employed is shown in phantom; and, FIG. 2 is an exploded perspective view of the three components defining the visor, within the encircling bracket, prior to assembly.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contempleted as would normally occur to one skilled in the art to which the invention relates.

Referring now to the figures, the visor 11 of the invention is shown in combination with body 12 (in phantom) of a conventional sport type cap. The visor 11 is defined by an outer layer 11*a* and an outer layer 11*b*, both dimensioned generally the same, and cut from vinyl plastic material, and an insert board 11*c*, made from cardboard or other paper material, for example, but dimensioned smaller than the outer layers 11*a* and 11*b*. The preceding relationship is evident in FIG. 2.

In any event, and after manufacture, the visor 11 has the appearance of FIG. 1, i.e. the insert board 11*c* is sandwiched between the outer layers 11*a* and 11*b*. Simulated stitch lines 11*d* typically appear on the upper surface of the visor 11. As should be understood from the description herebelow, the completed visor 11 is impervious to water, i.e. the board 11*c* is encapsulated in a water sealed relationship so as to prevent warping or the like. The stitch lines 11*d* add to the appearance of the finished visor 11.

In manufacture, one outer layer 11*b* is placed onto a jig (not shown), where insert board 11*c* is then positioned on the outer layer 11*b*. The assembly is completed by placing outer layer 11*a* over the insert board 11*c*. In that outer layers 11*a* and 11*b* are larger than the insert board 11*c*, when a heat seal die comes down onto the jig, the outer edges of the outer layers 11*a* and 11*b* are sealed together and the insert board 11*c* is self-contained. As an added step at this time, any excess vinyl plastic material may be stripped from the visor 11.

The completed visor envelope, including the insert board 11*c*, is then placed onto a hard silicone rubber mold at a flow mold machine. The aforesaid mold includes lines which simulate a conventional stitch pattern on a visor. With the passage of high frequency radio waves through the envelope, the vinyl plastic material is melted, causing the now semi-liquid vinyl material to flow in the mold, and with the aid of air pressure, the contours and patterns defined by the mold are achieved on the visor 11. A cooling period then follows. After the preceding, the visor is ready for conventional assembly into the desired sport type cap.

As stated, the invention provides a visor which is superior to those in use heretofore, i.e. one which not only eliminates machine stitching on the visor, but also, importantly, prevents any buckling of the insert board because of the sealed relationship of the latter within the visor. It should be understood that the stitching pattern on the visor can be modified from that shown, the overall shape varied, or other changes made within the spirit of the invention and, therefore, the preceding description should be considered illustrative and not as limiting the scope of the following claims:

I claim:

1. A visor for a cap comprising an upper vinyl plastic outer member, and insert board and a lower vinyl plastic outer member, where said upper vinyl plastic outer member and said lower vinyl plastic outer member are heat sealed together along the outer edges thereof to fully encapsulate said insert board in a water sealed relationship, and where said upper vinyl plastic outer member includes a pattern of molded simulated stitch lines on the top surface thereof.

2. The visor of claim 1 where said insert board is cardboard.

* * * * *